United States Patent [19]

Maximovich et al.

[11] Patent Number: 4,624,871

[45] Date of Patent: Nov. 25, 1986

[54] METHOD OF PRODUCING MULTICOMPONENT DIFFUSION COATINGS ON METAL ARTICLES AND APPARATUS FOR PERFORMING SAME

[75] Inventors: Georgy G. Maximovich; Yaroslav V. Ganysh; Viktor F. Shatinsky; Evgeny M. Ljuty; Ivan J. Tretyak, all of Lvov, U.S.S.R.

[73] Assignee: Fiziko-Mekhanichesky Institut Imeni Karpenko Akademii Nauk Ukrainskoi SSR, Lvov, U.S.S.R.

[21] Appl. No.: 788,467

[22] Filed: Oct. 17, 1985

[51] Int. Cl.[4] ..... C23C 8/58

[52] U.S. Cl. ..... 427/431; 118/429

[58] Field of Search ..... 427/431; 118/429

[56] References Cited

U.S. PATENT DOCUMENTS 2,656,595 10/1953 Stern ..... 427/431

FOREIGN PATENT DOCUMENTS 298701 3/1971 U.S.S.R. .

644869 1/1979 U.S.S.R. .

*Primary Examiner*—Sam Silverberg

*Attorney, Agent, or Firm*—Ladas & Parry

[57] ABSTRACT

A method of producing multicomponent diffusion coatings on metal articles comprises the steps of separately dissolving in a transport melt the alloying elements at temperature T equalling 0.5 to 0.8 of their respective melting points, and saturating with these alloying elements by diffusion the surface of a metal article at temperature $T_1$ equalling 0.3 to 0.5 of the melting point of the material of this article, with the difference $T-T_1$ being at least 50° C. To perform this method, the apparatus comprises a central chamber for accommodating the transport melt and the metal article to be coated, and two (in one embodiment) peripheral chambers for accommodating the transport melt and the respective individual alloying elements, communicating via ducts. All the chambers and ducts have heating elements arranged thereon.

5 Claims, 2 Drawing Figures

METHOD OF PRODUCING MULTICOMPONENT DIFFUSION COATINGS ON METAL ARTICLES AND APPARATUS FOR PERFORMING SAME

FIELD OF THE INVENTION

The invention relates to methods of thermal treatment of metals and their alloys and to apparatus for performing such methods, and more particularly it relates to methods of producing multicomponent diffusion coatings on metal articles and to apparatus capable of performing these methods.

The invention can be utilized to utmost advantage in producing multicomponent coatings on small articles of intricate shape made of various metals and alloys in instrument-making, e.g. cases subject to friction, contacts, leads and the like, in watch-making for coating cases, wristbands, parts of watch and clock movements, in chemical engineering for protection of parts against aggressive environments, e.g. for enhancing their heat resistance.

The invention can be further utilized in the manufacturing of fluid-handling valves and fittings, for their corrosion protection.

PRIOR ART

There is known a method of producing multicomponent diffusion coatings on metal articles made of copper, Armco iron, chrome-nickel and high-melting alloys and metals, by isothermal transfer of the diffusing elements (Cr, Ni, Mo, Fe, Ti) onto the surfaces of articles to be coated in melts of Na, Ca, Li, Bi, Pb (cf. SU Inventor's Certificate No. 298,701; Int. Cl. C23c 9/08, published Mar. 16, 1971).

According to this method, the process of dissolving various elements to be diffused and saturating with them by diffusion the surface of an article is conducted at one and the same high temperature, which results in their non-uniform dissolving, to say nothing of inadequate solubility of such elements as Cr or Mo, and in eventual corroding of the surface of the article. Consequently, the production of a coating of the required composition and density is badly hindered.

There is known an apparatus for producing multicomponent diffusion coatings on metal articles, capable of performing the abovementioned method, comprising means for accommodating the transport melt and the alloying elements, received in an electric oven (cf. the abovecited Inventor's Certificate).

In this apparatus the means for accommodating the transport melt and the alloying elements is in the form of an ampoule made of an inert material (i.e. a material insoluble in the saturating medium).

The process of saturation is conducted, as follows: an inert, e.g. argon atmosphere is established, the transport melt, e.g. a sodium or lithium melt is poured into the ampoule, the alloying elements, e.g. chromium and aluminum are poured thereinto, and the article on which the coating is to be produced is also placed into the ampoule. The ampoule is then sealed by welding and placed into an oven, e.g. electric muffle furnace for saturation by diffusion by keeping the ampoule in the furnace for a period and at a temperature sufficient for producing a coating of the predetermined thickness.

The process, as it can be seen from the abovesaid, is marked by a low throughput and impossibility of controlling the dissolving of the components, i.e. of applying the alloying elements in the required sequence for obtaining coatings of required compositions.

There is also known a method of producing multicomponent diffusion coatings on metal articles, including separately dissolving the alloying elements in the transport melt and saturating with them the surface of a metal article at elevated temperature (cf. SU Inventor's Certificate No. 644,869; Int.Cl.$^2$C23c 9/10, published Jan. 30, 1979).

The transport melt in this method is molten lead or bismuth, accommodating the alloying elements - titanium and nickel. Separate dissolving of the alloying elements in the transport melt and saturating with them the surface of an article is conducted successively at a temperature of 1100°–1150° C., for 0.5–1.0 hour. The number of the coating cycles depends on the required thickness of the coating.

It can be seen that this method cannot be used for obtaining on the surface of an article a coating in the form of required intermetallic or chemical compounds of a predetermined thickness and density.

Furthermore, the high saturation temperature leads to structural changes in the matrix of the coated articles and to corrosion of their surfaces.

There is also known an apparatus for producing multicomponent diffusion coatings on metal articles by performing the last-described method, comprising means for accommodating the transport melt and the alloying elements, surrounded by heating elements (cf. the last-cited Inventor's Certificate).

In this apparatus the means for accommodating the transport melt and alloying elements is in the form of two baths with the transport melt and the respective alloying elements, each bath being surrounded by heating elements.

The process of saturation is conducted successively in these two baths with the transport melt, e.g. with the melt of lead and bismuth, by periodically transferring the article being coated from one bath into the other. Each bath has the respective one of the alloying elements, e.g. titanium and nickel, dissolved therein.

This process is characterized by low throughput, impossibility of saturating simultaneously with several alloying elements and non-uniform distribution of the alloying elements through the volume of the bath.

SUMMARY OF THE INVENTION

It is an object of the present invention to create a method of producing multicomponent diffusion coatings on metal articles, providing for applying multicomponent diffusion coatings of required composition, thickness and density.

It is another object of the present invention to lower the saturation temperature, so as to avoid structural changes in the matrix of the article being coated and corrosion of the surface of this article.

It is yet another object of the present invention to create an apparatus for producing multicomponent diffusion coatings on metal articles, capable of performing the above method and providing for stepping up the efficiency of the process of saturation by diffusion.

It is a further object of the present invention to create an apparatus for producing multicomponent diffusion coatings on metal articles, capable of performing the above method and providing for uniform distribution of the alloying elements in the transport melt.

These and other objects are attained in a method of producing multicomponent diffusion coatings on metal articles, including the steps of separately dissolving the alloying elements in a transport melt and saturating with them the surface of a metal article at elevated temperature, in which method, in accordance with the present invention, separate dissolving of the alloying elements in the transport melt is conducted at a temperature T which is 0.5 to 0.8 of their respective melting points, and saturation with them of the surface of the article is conducted at a temperature $T_1$ equalling 0.3 to 0.5 of the melting point of the material of the article, with $T-T_1$ being at least 50° C.

The abovementioned upper limit of the saturation temperature $T_1$ has been chosen to account for higher temperatures, in excess of 0.5 $T_2$ (where $T_2$is the melting point of the material of the article), inducing in the material of the article certain structural changes, e.g. recrystallization, affecting the properties of the material.

The lower limit of the saturation temperature is explaned by lower temperatures, below 0.3 $T_2$, sharply affecting the diffusion mobility of the alloying elements in the solid melt of the material of the article, and thus lowering the rate of the deposition of the coating.

The temperature T of dissolving the alloying elements, equalling 0.5–0.8 $T_3$ (where $T_3$ is the melting point of the respective alloying element) provides for maintaining an optimized concentration of the elements in the transport melt for the process of applying the required coatings. The upper limit has been chosen to account for the fact that at temperatures in excess of 0.8 $T_3$ an excessively high concentration of the alloying elements dissolved in the transport melt is attained, yielding non-uniform spongy coatings. At temperatures below the lower limit of 0.5 $T_3$, on the other hand, the concentration of the alloying elements in the transport melt becomes insufficient for maintaining an adequately high rate of deposition of the alloying elements on the article. The temperature of dissolving should be higher than the saturation temperature by at least 50° C. to provide conditions for thermal transfer of the alloying elements by the transport melt.

It is expedient for obtaining a multicomponent coating of a complex composition to conduct the saturation of the surface of an article with the alloying elements simultaneously.

Alternatively, it is expedient for obtaining a multicomponent coating with gradual variation of the properties of the coating across its thickness, to conduct the saturation of the surface of an article with the alloying elements successively.

The objects of the invention are also attained in an apparatus for producing multicomponent diffusion coatings on metal articles, comprising means for accommodating the transport melt and alloying elements, surrounded by heating elements, in which apparatus, in accordance with the invention, the means for accommodating the transport melt and alloying elements includes a central chamber for accommodation of the transport melt, adapted to receive therein the metal article to be coated, and at least two peripheral chambers for accommodation of the transport melt and of the respective individual alloying elements, communicating each with the central chamber adjacent to its ends via two respective ducts, the heating elements being arranged on each one of the chambers and on each one of the communication ducts.

It is expedient that the apparatus should comprise means for agitating the transport melt, accommodated in the central chamber.

This construction of the disclosed apparatus for producing multicomponent diffusion coatings on metal articles, capable of performing the method according to the invention, provides for applying multicomponent diffusion coatings of a required composition on metal articles made of various materials, for speeding up the process of saturation by diffusion and for lowering the temperature of saturation by diffusion.

SUMMARY OF THE DRAWINGS

These and other objects of the present invention will be better understood from the following examples and embodiments thereof, with reference being made to the accompanying drawings, wherein.

DETAILED DISCLOSURE OF THE INVENTION

Figure 1:
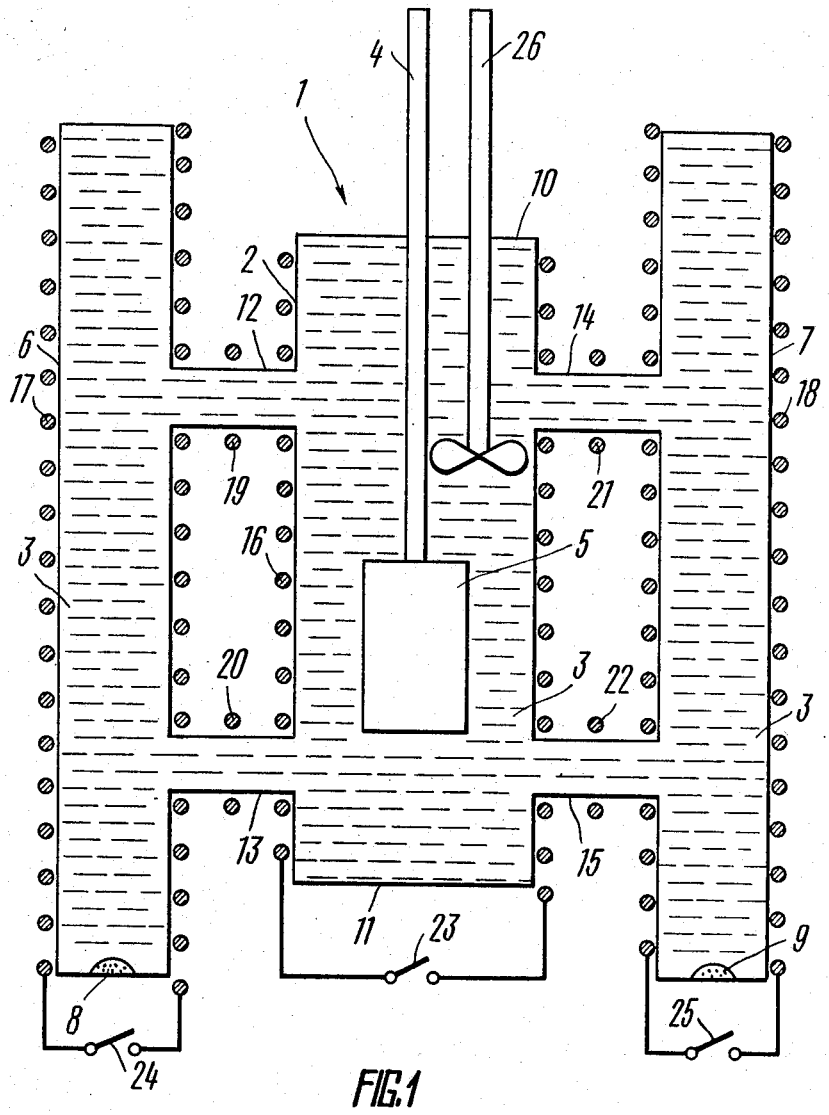
FIG. 1 is a longitudinally sectional schematic view of the disclosed apparatus for producing multicomponent diffusion coatings on metal articles, capable of performing the method according to the invention.

The method of producing multicomponent diffusion coatings on metal articles, according to the invention, includes the steps of furnishing a metal article to be coated, e.g. made of a chromium-nickel alloy or niobium, and also furnishing a transport melt as a melt of low-melting metals, e.g. sodium, and alloying elements which may be Mo, Cr, Ti, Ni, Si, Hf.

Then the article to be coated is placed in the transport melt, and the alloying elements are separately dissolved in the transport melt at a temperature T which is 0.5 to 0.8 of their respective melting points, whereafter the alloying elements are diffused into the surface of the metal article at a temperature $T_1$ which is 0.3 to 0.5 of the melting point of the material of the article, the temperature T being higher than the temperature $T_1$by at least 50° C. (i.e. $T-T_1 \geqq 50°$ C.).

The process is conducted for a time sufficient for obtaining the required coating. All the above-mentioned operations are conducted in an inert gas atmosphere, i.e. the pouring-in of the transport melt, the pouring-in or charging of the alloying elements, the dipping of the article into the transport melt and the diffusion or saturation.

The surface of the article is saturated with the alloying elements simultaneously when a multicomponent coating of a complex composition is required. Alternatively, when a multicomponent coating with gradual variation of its properties across the thickness of the coating is required, the saturation of the surface of the article with the alloying elements is conducted successively.

There is hereby disclosed an apparatus for producing multicomponent diffusion coatings on metal articles, capable of performing the abovedescribed method according to the invention.

The apparatus for producing multicomponent diffusion coatings on metal articles, which are two-component coatings in the embodiment being described, in accordance with the invention, comprises means 1 (FIG. 1) for accommodating the transport melt and the alloying elements. The means 1 includes a central chamber 2 for accommodating the transport melt 3, e.g. a sodium melt, into which a holder 4 with an article 5 to be coated is placed, and two peripheral chambers 6 and 7 for accommodating the transport melt 3 and the respective individual alloying elements 8 and 9, i.e. the chamber 6 is adapted to accommodate the alloying element 8—titanium, and the chamber 7 is adapted to accommodate the alloying element 9—nickel.

Each one of the chamber 6 and 7 communicates with the central chamber 2 adjacent to its ends 10 and 11 via two respective ducts 12, 13 and 14, 15.

Arranged on and about each one of the chambers 2, 6 and 7 and each one of the ducts 12, 13, 14 and 15 are heating elements 16, 17, 18, 19, 20, 21 and 22 in the form of respective electric heating coils. The heating elements 16, 19, 20, 21 and 22 are electrically controlled with an on-off switch 23, and the heating elements 17 and 18 are electrically controlled with the respective on-off switches 24 and 25.

The central chamber 2 additionally receives the means 26 for agitating the transport melt 3.

Figure 2:
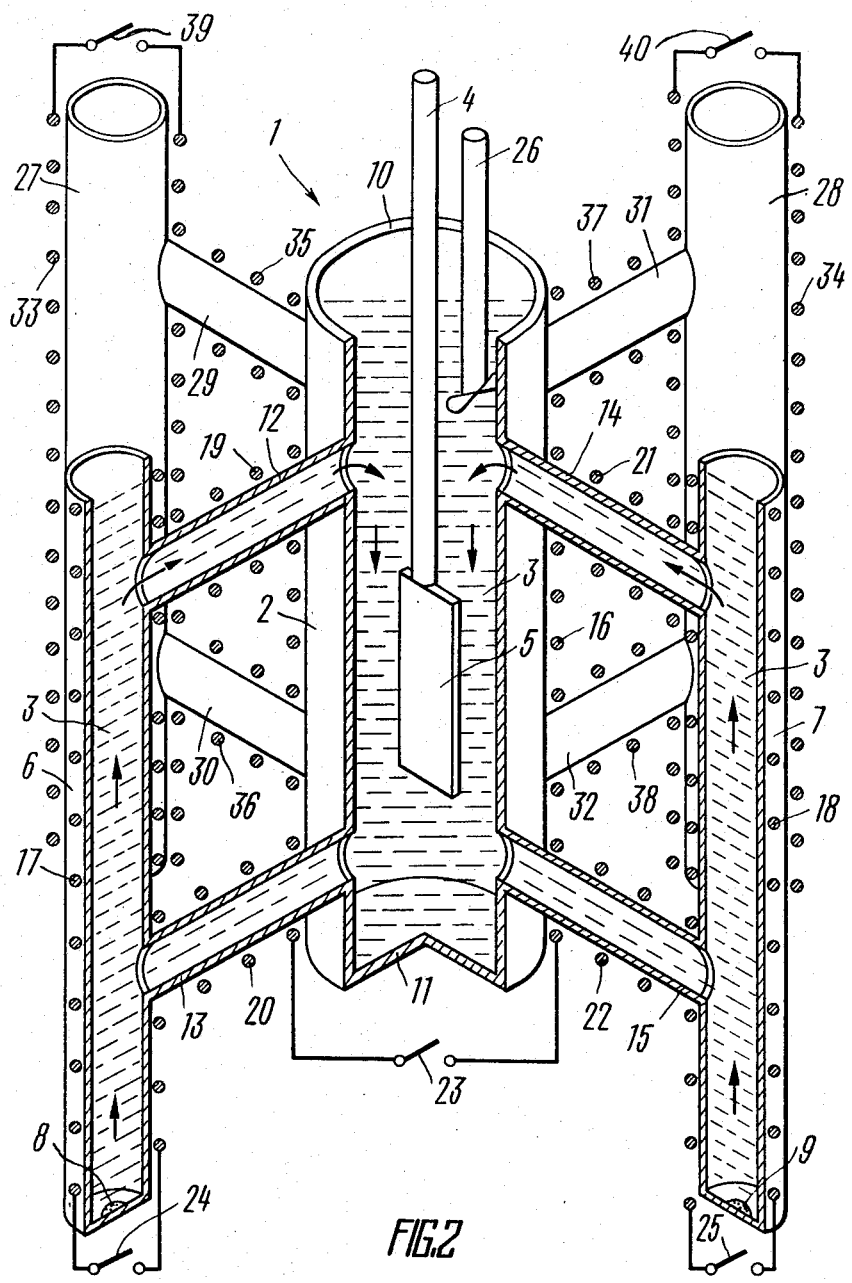
FIG. 2 is a partly broken away perspective schematic view of a modification of the disclosed apparatus for producing multicomponent diffusion coatings on metal articles, capable of performing the method according to the Invention.

Schematically illustrated in FIG. 2 is a modification of the herein disclosed apparatus for producing four-component coatings on metal articles by performing a method according to the present invention. This modification of the apparatus for performing the claimed method is basically similar to the apparatus for performing a method according to the present invention, illustrated in FIG. 1.

The difference is in that the means 1 (FIG. 2) for accommodating the transport melt and the alloying elements comprises not two, but four peripheral chambers 6, 7, 27, 28 for accommodating the transport melt 3 and the respective individual alloying elements, the chamber 6 accommodating the alloying element 8—molybdenium, the chamber 7 accommodating the alloying element 9—chromium, and the chambers 27 and 28 accommodating, respectively, hafnium and silicon as the alloying elements.

Same as the chambers 6 and 7, the peripheral chambers 27 and 28 communicate with the central chamber 2 adjacent to its opposite ends 10 and 11 via two respective ducts 29, 30 and 31 and 32. Arranged on and about each one of the chambers 27 and 28 and each one of the ducts 29, 30, 31 and 32 are heating elements 35, 36, 37 and 38 in the form of respective electric heating coils. The heating elements 35, 36, 37 and 38 are electrically associated with an on-off control switch 23, and the heating elements 33 and 34 are electrically associated with the respective on-off control switches 39 and 40.

The operating principle of the disclosed apparatus for producing multicomponent diffusion coatings on metal articles by performing the method in accordance with the present invention, as follows.

The article 5 (FIG. 1) on the holder 4 is placed into the central chamber 2. The alloying elements 8 and 9 (e.g. titanium and nickel) in a pulverized form are poured into the two respective peripheral chambers 6 and 7, and the transport melt 3, (e.g. a sodium melt) is poured into the chambers 2, 6 and 7. Then the on-off switches 23, 24 and 25 are operated to turn on the power supply of the heating coils 16, 17 and 18, and the temperature of the transport melt 3 in the chamber 2 is raised to 0.3–0.5 of the melting point of the material of the article 5 being coated, while the temperature of the transport melt 3 in the chambers 6 and 7 is raised to 0.5–0.8 of the melting points of the respective alloying elements 8 and 9. The temperature of the transport melt 3 in the central chamber 2 is maintained by at least 50° C. lower than the temperature of the transport melt 3 in the peripheral chambers 6 and 7. Then the means 26 for agitating the transport melt 3 is turned on, and the metal article 5 being coated is kept in the central chamber 2 for a period sufficient for obtaining the required coating. In this way the surface of the metal article 5 is simultaneously saturated by diffusion with the alloying elements 8 and 9.

To saturate by diffusion the surface of the metal article 5 with the alloying elements 8 and 9 in succession, operations similar to those described above are likewise conducted in a sequence.

The difference resides in that in this case the switches 23, 24 are operated to turn on the power supply of the heating coils 16 and 17, and the temperature of the transport melt 3 in the central chamber is raised to 0.3–0.5 of the melting point of the material of the article 5 to be coated, while in the peripheral chamber 6 alone the temperature is raised to 0.5–0.8 of the melting point of the alloying element 8, the temperature of the transport melt 3 in the central chamber 2 being maintained by 50° C. or more lower than the temperature of the melt 3 in the peripheral chamber 6. Then the agitating mechanism 26 is activated, and the metal article 5 being coated is kept in this state for a time sufficient for required saturation of the surface of the part 5 with the alloying element 8, whereafter the power supply of the heating coil 17 is turned off with the switch 24. Then the power supply of the heating element 18 is turned on with the switch 25, and the surface of the article 5 is saturated with the alloying element 9 under the abovedescribed conditions.

The operation of the modification of the disclosed apparatus illustrated in FIG. 2 is similar to that of the apparatus illustrated in FIG. 1.

For the present invention to be better comprehended, there are given below examples of performance of the method according to the invention in the herein disclosed apparatus.

EXAMPLE 1

The process is conducted in the modification of the apparatus for producing a two-component coating with simultaneous diffusion of two alloying elements, illustrated in FIG. 1.

Poured into the peripheral chambers 6 and 7, respectively, are powders of the alloying element 8 (titanium, 5–10% by weight, melting point 1668° C.) and of the alloying element 9 (nickel, 10–20% by weight, melting point 1453° C.), and then the chambers 2, 6, and 7 are filled with the transport melt 3 (sodium melt, the rest by weight).

Then the switches 23, 24 and 25 are operated to turn on the power supply of the heating coils 16, 17 and 18, and the temperature of the transport sodium melt 3 in the chamber 2 is raised to the temperature $T_1=477°$ C. (0.3 of the melting point of the material of the article 5, equalling 1590° C.), the temperature of the sodium melt 3 is raised in the chamber 6 to the temperature $T=834°$ C. (0.5 of the melting point of titanium, equalling 1668° C.), and in the chamber 7 to the temperature $T=726°$ C. (0.5 of the melting point of nickel, equalling 1453° C.). In this way the difference between the respective temperature of the sodium melt 3 in the chamber 2 and in the chambers 6 and 7 is maintained at a value in excess of 50° C.

Then the article 5 of chromium-nickel alloy steel, of the following composition (% by weight): C=0.08; Mn=1-2; Cr=17-19; Ni=9-11; Ti-0.7; Fe --the rest (the melting point of this material of the article 5 is 1590° C.), of a 5×10×1 mm size is lowered into the chamber 2. The agitation mechanism 26 is actuated, and the article 5 is kept in the chamber 2 for 4 hours. Then the article 5 is removed and washed in running water.

All the operations are performed in an inert argon atmosphere.

The procedure yields uniform, pore-free titanium-nickel diffusion coating of about 40 μm thickness.

The structure of the coating thus obtained is a $Ni_3Ti$ intermetallic compount in a solid nickel-base solution.

The coating has proved to have high corrosion resistance in both acid and alkali media. Thus, the rate of corrosion in 5% aqueous solution of $HNO_3$and 10% aqueous solution of NaOH is, respectively, 0.01 mm/year and 0.003 mm/year.

EXAMPLE 2

As compared with Example 1, the process differs in that the temperature of the melt 3 of sodium in the chamber 2 is maintained at $T_1$=636° C. (0.4 of the melting point of the material of the article 5, equalling 1590° C.), the temperature of the melt 3 in the chamber 6 is maintained at T=834° C. (0.5 of the melting point of titanium), and the temperature in the chamber 7 is maintained at T=726° C. (0.5 of the melting point of nickel). Thus, the difference between the temperatures of the melt 3 in the chamber 2 and in the chambers 6 and 7 is maintained at a value in excess of 50° C.

The procedure yields a uniform pore-free titanium-nickel diffusion coating of 50 μm thickness. The properties of the coating are similar to those described in connection with Example 1.

EXAMPLE 3

As compared with Example 1, the process differs in that the temperature of the sodium melt 3 in the chamber 2 is $T_1$=795° C. (0.5 of the melting point of the material of the article 5, equalling 1590° C.), the temperature of the melt 3 in the chamber 6 is T=834° C. (0.5 of the melting point of titanium), and the temperature of the melt 3 in the chamber 7 is T=871° C. (0.6 of the melting point of nickel). Thus, the difference between the temperatures of the sodium melt 3 in the chamber 2 and in the chamber 6 is substantially equal to 50° C., and in the chambers 2 and 7 exceeds 50° C.

The procedure yeilds a coating of a 55 μm thickness, of properties identical to those described in connection with Example 1.

EXAMPLE 4

Unlike Example 2, the process according to the invention is conducted so that the saturation of the surface of the metal article 5 with the alloying elements 8 and 9 is effected in succession. The sequence of the operations involved is in other respects similar to that described in Example 1.

The process differs in that, first, the power supply of the heating coils 16 and 17 is turned on with the switches 23 and 24, and the temperature of the sodium melt 3 is raised in the chamber 2 to $T_1$=795° C. (0.5 of the melting point of the material of the article 5, equalling 1590° C.) and in the chamber 6 to T=1008° C. (0.6 of the melting point of titanium). Thus, there is maintained a difference between the temperatures of the sodium melt 3 in the central chamber 2 and the peripheral chamber 6 in excess of 50° C.

Then the agitating mechanism 26 is actuated, and the article 5 being coated is kept in the chamber 2 for 4 hours for the surface of the article 5 to become saturated with titanium. Then the power supply of the heating coil 17 is turned off with the switch 24, and the power supply of the heating coil 18 is turned on with the switch 25 to raise the temperature of the melt 3 in the chamber 7 to T=1160° C. (0.8 of the melting point of nickel). Thus, there is maintained a difference between the temperatures of the sodium melt 3 in the central chamber 2 and peripheral chamber 7 in excess of 50° C. Under these conditions the article 5 is kept for 4 hours, for the surface of the article 5 to become saturated with nickel. Then the article 5 is removed and washed in running water.

The procedure yields a uniform pore-free titanium-nickel diffusion coating of about 60 μm thickness. The coating is a double-layer one, the first layer being a solid solution of titanium in iron. The second layer is $No_3Ti$ intermetallic compound in a solid solution of iron and titanium. The properties of the coating are 1.5 times higher then those of the coating obtained in Example 1.

EXAMPLE 5

This example is associated with FIG. 2 of the appended drawings where a modification of the disclosed apparatus for producing a four-component coating in simultaneous saturation with four alloying elements is schematically illustrated.

Powders of the alloying elements: molybdenum (10% by weight; melting point 2620° C.), chromium (10% by weight; melting point 1875° C.), hafnium (10% by weight; melting point 2222° C.) and silicon (10% by weight; melting point 1415° C.) are poured, respectively, into the peripheral chambers 6, 7, 27 and 28 which are subsequently filled with the transport sodium solution 3 (the rest by weight).

Then the power supply of the heating coils 16, 17, 18, 33 and 34 is turned on with the switches 23, 24, 25, 39 and 40 to raise the temperature of the transport sodium melt 3 in the chamber 2 to temperature $T_1$=987° C. (0.4 of the melting point of the material of the article 5, equalling 2468° C.), in the chamber 6 to temperature T=1310° C. (0.5 of the melting point of molybdenum, equalling 2620° C.), in the chamber 7 to temperature T=1125° C. (0.6 of the melting point of chromium, equalling 1875° C.), in the chamber 27 to temperature T=1111° C. (0.5 of the melting point of hafnium, equalling 2222° C.), in the chamber 28 to temperature T=1132° C. (0.8 of the melting point of silicon, equalling 1415° C.). Thus, the difference between the temperatures of the transport sodium solution 3 in the chamber 2, on the one hand, and in the chambers 6, 7, 27 and 28, on the other, is maintained at values in excess of 50° C.

Then the metal article 5 of niobium (melting point 2468° C.) of a 5×10×1 mm size is lowered into the chamber 2. The agitating mechanism 26 is actuated and the article 5 is kept in the chamber 2 for 8 hours. Then the article 5 is removed and washed in running water.

The procedure yields a solid coating, uniform over the entire periphery of the article 5, of a 60 μm thickness. The coating contains the following phases: $NbSi_2$, $MoSi_2$, $Cr_5Si_3$, CrHf.

The coating renders the high-melting base metal oxidation-proof. The article with the coating produced in the abovedescribed procedure was heated in open air at 1000° C. for 25 hours, with no significant traces of oxidation and penetration of oxygen observed.

EXAMPLE 6

Unlike Example 5, the method according to the invention is conducted for successive saturation of the surface of the article 5 (FIG. 2) with the alloying elements. The sequence of the operations is generally similar to Example 5.

The difference is in that, first, the power supply of the heating coils 16 and 17 is turned on with the switches 23 and 24, to raise the temperatures of the sodium melt 3 in the chamber 2 to $T_1=987°$ C., and in the chamber 6 to $T=1310°$ C. In this way the difference between the temperatures of the sodium melt 3 in the central chamber 2 and in the peripheral chamber 6 is maintained higher than 50° C.

Then the agitation mechanism 26 is actuated, the metal article 5 of niobium is lowered into the chamber 2 and kept there under these conditions for 3 hours. This exposure results in saturation of the surface of the article 5 with molybdenum.

Then the power supply of the heating coil 17 is turned off with the switch 24. The power supply of the heating coil 18 is turned on with the switch 25, to raise the temperature of the melt 3 in the chamber 7 to $T=1125°$ C., and the article 5 is kept under these conditions for 3 hours. This exposure yields saturation of the surface of the article 5 with chromium.

Then the power supply of the heating coil 18 is turned off with the switch 25, and the power supply of the heating coil 33 is turned on with the switch 39, to raise the temperature of the melt 3 in the chamber 27 to 1111° C., and the article 5 is kept under these conditions for 3 hours, which yields saturation of the surface of the article 5 with hafnium.

Then the power supply of the heating coil 33 is turned off with the switch 39, and the power supply of the heating coil 34 is turned on with the switch 40, to raise the temperature of the melt 3 in the chamber 28 to $T=1132°$ C., and the article 5 is kept under these conditions for 3 hours.

Thus, the difference between the temperatures of the sodium melt 3 in the central chamber 2 and in the peripheral chambers 7, 27, and 28 is maintained at values in excess of 50° C.

The procedure yields a four-layer diffusion coating containing complex phases based on Nb, Mo, Cr, Hf and Si. The properties of the coating are similar to those of the coating produced in Example 5.

In the above description of the embodiments of the invention and examples, specific concrete terms have been used for clarity sake. The invention, however, is in no way limited by these terms, and it should be understood that each term is meant to embrace all the equavalent means operating in a similar manner and employed for solving similar problems.

Although the present invention has been described in connection with certain preferred embodiments and examples, it is understood that various modifications and changes may take place without departing from the spirit and scope of the invention, which those competent in the art will easily comprehend.

Such modifications and changes are considered as falling within the spirit and scope of the invention, as set forth in the claims to follow.

We claim:

1. A method of producing multicomponent diffusion coatings on metal articles, in a melt including the steps of:

separately dissolving alloying elements in a transport melt at temperature T equalling 0.5 to 0.8 of their respective melting points by selectively heating each element in a peripheral chamber connected by a duct to a central chamber containing said metal article; and maintaining the surface of said metal article at a temperature of T, equalling 0.3 to 0.5 of the melting of said article with the difference T-Ti being at least 50° C. thereby causing the alloying elements to diffuse into the surface of said metal article.

2. A method as set forth in claim 1, wherein:

said alloying elements are diffused simultaneously in the surface of said metal article.

3. A method as set forth in claim 1, wherein:

said alloying elements are diffused successively.

4. An apparatus for producing multicomponent diffusion coatings on metal articles, comprising:

a central chamber for accommodating a transport melt, adapted for lowering thereinto said metal article to be coated, said central chamber having the first end and the second end;

at least two peripheral chambers for accommodating said transport melt and individual respective alloying elements, communicating each with said central chamber adjacent to said first end and said second end thereof;

a first duct and a second duct through which said central chamber and each said respective peripheral chamber communicate, respectively, adjacent to said first end of said central chamber and said second end of said central chamber;

a plurality of heating elements surrounding all said chambers and all said ducts and arranged on each one of said chambers and on each one of said ducts and means for selectively heating the alloying elements in said ducts and the metal article in said control chamber.

5. An apparatus as set forth in claim 4, comprising:

means for agitating said transport melt in said central chamber.

* * * * *